United States Patent [19]

Bentz et al.

[11] 4,179,103

[45] Dec. 18, 1979

[54] MEANS FOR INJECTING GAS INTO A MOLTEN METAL

[75] Inventors: Gérard Bentz, Elancourt-Trappes; Bernard Racouchot, Franconville, both of France

[73] Assignee: L'Air Liquide, Societe Anonyme Pour L'Etude Et L'Exploitation Des Procedes Georges Claude, Paris, France

[21] Appl. No.: 873,618

[22] Filed: Jan. 30, 1978

[30] Foreign Application Priority Data

Feb. 10, 1977 [FR] France ..... 77 03701

[51] Int. Cl.[2] ..... C22B 21/06; C21C 7/00

[52] U.S. Cl. ..... 266/225; 266/220

[58] Field of Search ..... 266/216, 217, 225, 226, 266/220

[56] References Cited

U.S. PATENT DOCUMENTS

| | | | |
|---|---|---|---|
| 3,033,550 | 5/1962 | Harders . | |
| 3,053,525 | 9/1962 | Leroy et al. | 266/220 |
| 3,503,597 | 3/1970 | Kessler et al. | 266/225 |
| 3,565,412 | 2/1971 | Moniot | 266/225 |
| 3,610,602 | 10/1971 | Deacon et al. | 266/220 |
| 3,799,522 | 3/1974 | Brant et al. | 266/225 |

*Primary Examiner*—Gerald A. Dost

*Attorney, Agent, or Firm*—Lee C. Robinson, Jr.

[57] ABSTRACT

A gas delivery tube including tubular body portion of refractory material having a recess adjacent one end in which recess is housed a porous element for emitting small bubbles containing the gas. The body portion is provided with an internal gas inlet pipe, one end of which opens into an internal chamber in communication with said recess while at its other end the pipe terminates in means enabling it to be connected to a supply of gas.

The delivery tube is especially useful for degasifying aluminium, copper, and their alloys.

11 Claims, 4 Drawing Figures

MEANS FOR INJECTING GAS INTO A MOLTEN METAL

SUMMARY OF THE INVENTION

The present invention relates to a device for injecting a gas into a mass of molten metal for the purpose of treating the said metal, for example to degasify it, said device comprising a tubular body made from an impermeable refractory material, and a porous element, hereinafter termed a nozzle, which is intended to be connected to a source of gas under pressure and to emit the said gas in the form of small bubbles.

Delivery tubes and nozzles for degasifying molten non-ferrous metal are known which are formed from a straight tubular body portion of impermeable graphite, to one end of which is screwed a nozzle which is either made from porous graphite or from impermeable graphite which has been provided with small holes therethrough to allow the gas to pass therethrough. Tubes of this kind have various disadvantages: they do not withstand mechanical impact well, as a result of which they are difficult to handle because of their fragility, and they are soon damaged by combustion when in the bath of metal. In addition, the nozzle, which is generally frustoconical in shape, has its axis aligned with the axis of the body of impermeable graphite, which means that, when the rod dips into a bath of metal vertically, bubbles of gas escaping from the nozzle tend to coalesce along the surface of the tube and thus to be unsatisfactorily dispersed throughout the mass of molten metal. Perforated elements also have the disadvantage of emitting large bubbles which result in poor degasification and an excessive consumption of the treating gas. Moreover, there is a danger of the holes becoming blocked as a result of the entry of liquid metal.

Degasifying tubes are also known which are formed from a L-shaped hollow body, the horizontal arm of which serves as a nozzle for the introductionn of gas. Tubes of this kind, which are made in one piece, suffer from the drawback that they are permeable throughout, which makes it necessary to use a special gas inlet arrangement so as to confine the injection zone solely to the horizontal arm of the L; this complicates manufacture. Such tubes also have poor resistance to mechanical impact. Finally, the porosity of the injection zone is not sufficiently uniform.

The present invention has for an object to overcome these various disadvantages and to this end seeks to provide a delivery tube in which the refractory material forming the body of the tube is impermeable and in which the body of the tube is provided with a recess in which a porous element is housed and the delivery tube is provided with an internal passage, one end of which opens into a chamber communicating directly with the said recess whilst the other end is at the opposite end of the passage from the said recess.

The body of the delivery tube is made from impermeable refractory material and thus has satisfactory resistance against mechanical impact and does away with the need for providing a special arrangement for feeding in the gas for injection. In addition, the use of a porous element which is housed in a recess in the tube provided for this purpose enables both the injection zone to be accurately defined and the said porous element to be effectively protected. Finally, the fact that the gas inlet passage opens into a chamber which is in direct communication with the recess enables the porous element to be supplied with gas under the best possible conditions.

According to another feature of the invention, the body of the delivery tube comprises a straight shaft and a similarly straight head which is in angled connection with the shaft and which forms an angle of approximately 135° therewith, the said head being provided with the said recess and the said chamber. As a result, the porous element is offset from the axis of the shaft, and this prevents the phenonomen of bubbles of gas coalescing along the external surface of the body of the tube.

In accordance with another feature of the invention, the material forming the body of the delivery tube is an aluminous material having an alumina content of between 93 and 99% by weight.

The invention also provides a method of manufacturing a delivery tube of the kind mentioned above, which method includes the steps of separately producing, by moulding, from a granular material and a binder, the aforesaid deliveery tube provided with the recess and the gas passage therethrough, and the aforesaid porous element, then inserting the porous element in the recess and then subjecting the assembly to heat treatment in an oven at a temperature of approximately 400° to 500° C. for substantially 12 hours.

DETAILED DESCRIPTION

The invention will now be described with reference to the accompanying drawings, which illustrate preferred embodiments of the invention and in which.

Figure 1:
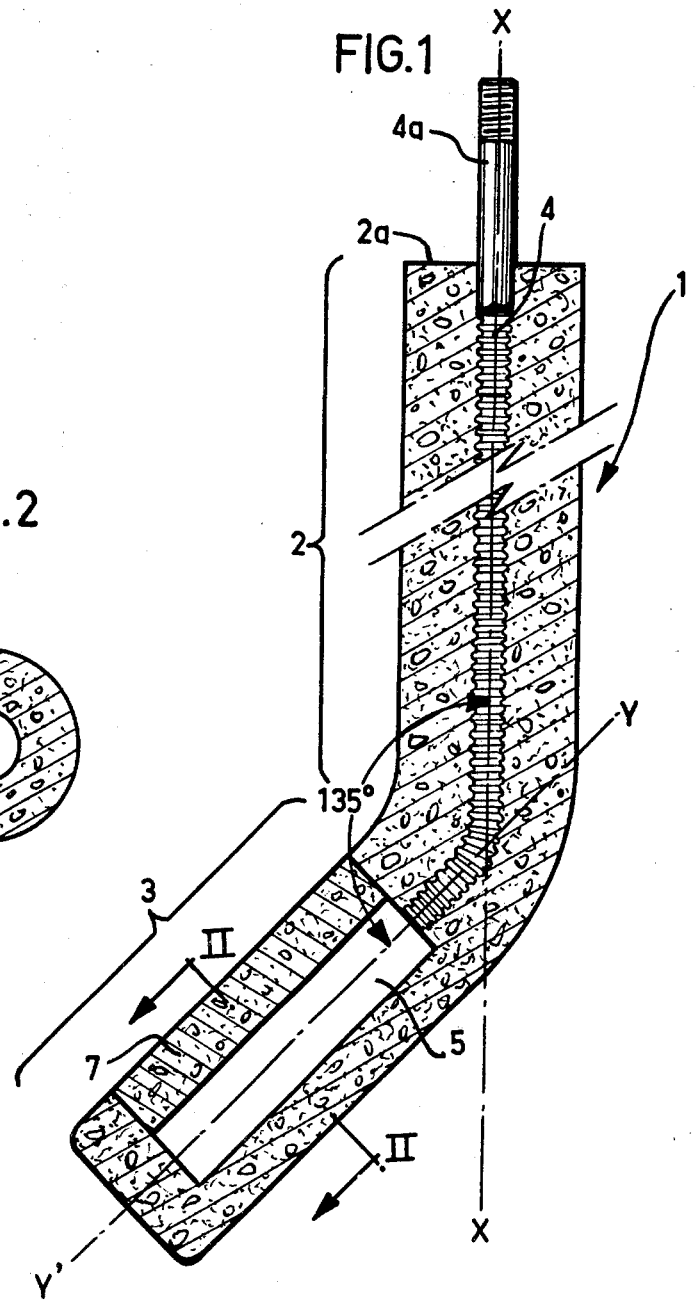
FIG. 1 is a cross-section through one embodiment of a delivery tube in accordance with the present invention.
Figure 2:
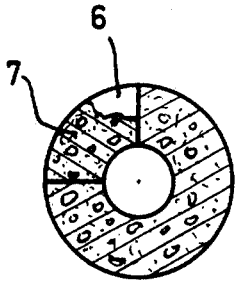
FIG. 2 is a cross-section on line II—II of FIG. 1.

In the embodiment shown in FIGS. 1 and 2 of the drawings, the delivery tube according to the invention has a body 1 of an impermeable refractory concrete or cement in the general shape of an angled cylindrical rod of circular cross-section. The body 1 includes a shaft 2 and a head 3 whose respective axes XX' and YY' form an angle of substantially 135°. The interior of the body 1 is provided with a gas inlet tube 4 embedded within it with one end opening into a chamber 5 formed in the angled head 3. The chamber 5 communicates with a recess 6 which is also formed in the angled head 3 and in which is housed a porous element 7 made of gas-permeable concrete or cement. The tube 4 is formed from a steel tube of which the part embedded in the concrete is corrugated, whilst the upper end 4*a* projects from the end 2*a* of the shaft 2 and is intended to be connected to a source of gas under pressure (not shown) in FIGS. 1 and 2. The recess 6, which in cross-section is in the form of a sector subtending an angle of approximately 90°, is formed in a zone of the head which constitutes the upper portion of the latter when the shaft is vertically disposed.

The material forming the shaft 2 and the head 3 is a mouldable refractory concrete having a high alumina content (93 to 99%) which is essentially made from:

(i) a refractory granular material such as tabular alumina having a granule size of from 3 to 7 millimeters, and (ii) an aluminous binder based upon sodium aluminate such as the product known by the trade name "SECAR 250".

The permeable concrete or cement forming the porous element 7 may be one of the following materials:

(a) A concrete identical with the previous concrete used to produce the body (granulated tabular alumina and a binder based on sodium aluminate), which has however been rendered permeable by the addition of a product which is eliminated during baking (particles of cork, sawdust or a foaming material which evolves gas under the action of heat);

(b) A permeable refractory material based on electrically melted alumina, the composition of which material may, for example, be as follows:

(i) a refractory granular material formed from 60 to 120 grade white corundum (80 to 90% by weight) and from fine reactive alumina (10 to 20%) and (ii) a chemical binder of aluminium monophosphate (5 to 7% of the weight of the granular material).

(c) A naturally permeable mouldable concrete; or (d) A concrete identical with that used for the body (granulated tabular alumina and a binder based on sodium aluminate) which has however been rendered permeable by the addition of ceramic fibres (fibres made from an alumino-silicate) or of thermally insulating fibres (for example, carbon fibres). The fibres, the length of which is a few millimeters, are mixed with the concrete in the following proportion: 1 volume of concrete to 1.5 to 4 volumes of fibres.

The gas inlet tube is formed of a steel tube which may be:

(a) A corrugated tube such as the tube 4 shown in FIG. 1.

The corrugated configuration given to the delivery tube improves the holding action of the concrete and allows for the expansion and contraction of the metal to be absorbed when the delivery tube is in use, which contraction and expansion otherwise may cause cracks in the refractory material.

(b) A rigid steel tube sheathed with refractory alumino siliceous paper approximately 1 millimeter thick. The paper acts as a resilient connecting link between the refractory concrete and the metal tube and absorbs differences in expansion and contraction which occur during use.

(c) A rigid steel tube which is mounted within the body 1 in spaced relation with the wall of the shaft of the delivery tube.

Figure 3:
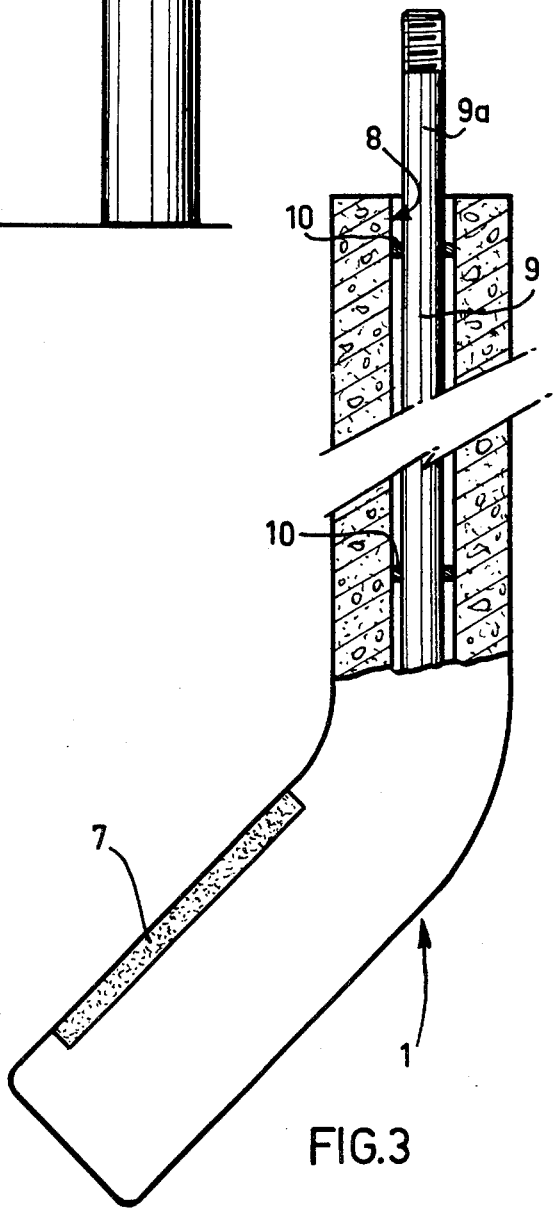
FIG. 3 is a cross-section through a second embodiment of the tube according to the present invention.

In this case (see FIG. 3) the body 1 is provided with an axial passage 8 therethrough which opens into the chamber 5 and within which passage is located the said rigid steel tube 9, of which one part 9*a* projects from the end of the delivery tube. The tube 9 is secured within the body 1 by means of annular members 10 which both anchor the tube and provide a seal in the part of the passage 8 which surrounds the said tube, thus preventing gas from rising up the annular passage from the chamber 5.

In accordance with the invention, the aforesaid delivery tube is manufactured by a method which essentially consists in producing, by moulding, the body 1 and the porous element 7 (which latter may either be moulded separately or moulded in the recess provided in the body), and then subjecting the assembly of the body and the porous element to suitable heat treatment.

The moulding of the body 1 is performed by vibratory casting: the refractory granular material and the binder are poured into a mould which is subject to mechanical vibration. The gas inlet pipe and cores for forming the chamber 5 and the recess 6 are positioned within the mould.

The porous element may be produced separately: the granular material and the binder are then cast in a mould of suitable shape and the element, after having been removed from the mould and after the body has also been removed from its mould, is fitted into the recess 6 by tamping. The porous element may equally well be moulded directly in the aforesaid recess. In this case the aforesaid granular material and binder are poured into the said recess after the body has been removed from its mould.

The delivery tube, provided with the porous element, is then baked in an oven so as to subject both to a heat treatment which raises them to a temperature of between 400°and 500° C. for a period which may be from 8 to 12 hours.

Figure 4:
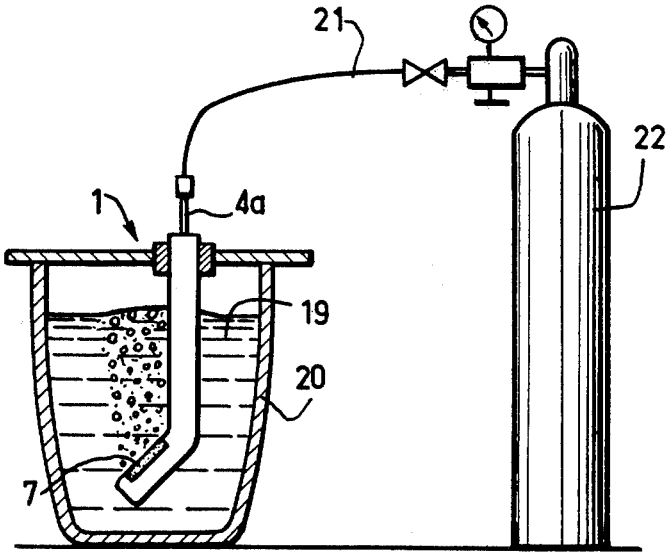
FIG. 4 is a schematic view showing a delivery tube according to the invention used for degasifying a molten metal.

In FIG. 4 is shown a manner of using the delivery tube according to the invention as applied to degasifying a bath of molten metal.

The molten metal 19, which may be an aluminium silicon alloy of the A-S7G type, which requires to be subjected to a dehydrogenation treatment, is contained within a crucible containing 250 kg of the said alloy. The temperature of the bath is 730° C. The delivery tube 1 dips into the bath vertically (i.e. the axis XX' is vertical). The inlet tube is connected, by means of a pipe 21, to a container 22 holding nitrogen under pressure. Particulars of the degasifying operation are as follows:

Throughput of nitrogen 40 l/m at STP duration of operation 12 min.

Checks on the degree to which the thus treated metal is degasified show that the solidified metal is virtually free from pores.

We claim:

1. A delivery device for injecting a gas into a mass of molten metal, the device comprising, in combination:

an elongate member of impermeable refractory material, the elongate member including a straight body portion and a straight head portion having an angled connection with the body portion, the head portion including a closed end, a side wall disposed between the closed end and the body portion, and a recess extending inwardly into the head portion from said side wall;

a porous refractory element located in the recess; and a gas inlet conduit positioned within the elongate member, the inner end of the conduit being in open communication with the recess.

2. A delivery device as claimed in claim 1 in which said impermeable refractory material is an aluminous refractory material having an alumina content of from 93 to 99% by weight.

3. A delivery device as claimed in claim 2 in which said aluminous refractory material is formed from granulated tabular alumina having a granule size of from 3 to 7 millimeters which has been agglomerated with a binder comprising sodium aluminate.

4. A delivery device as claimed in claim 1 in which said porous element consists essentially of a porous aluminous refractory material formed from granular tabular alumina having a granule size of from 3 to 7 millimeters bound with a binder comprising sodium aluminate.

5. A delivery device as claimed in claim 4 in which said aluminous refractory material is a permeable refractory material having a basis of electrically melted alumina together with a binder therefor.

6. A delivery device as claimed in claim 5 in which said permeable refractory material consists of a mixture of 80–90% by weight of 60 to 120 grade white corundum and 20–10% by weight of fine reactive alumina which has been bound with 5–7% of its weight of aluminium monophosphate.

7. A delivery device as claimed in claim 1 in which said porous element consists essentially of a concrete formed from granulated tabular alumina bound with a binder comprising sodium aluminate and rendered permeable by the additionn of ceramic fibers or of thermally insulating fibers in the proportion of 1 volume of concrete to 1.5 to 4 volumes of fibres.

8. A delivery device as claimed in claim 1 in which said gas inlet conduit comprises a corrugated steel tube.

9. A delivery device as claimed in claim 1 in which said gas inlet conduit comprises a rigid steel tube sheathed by a layer of a refractory alumino-silicaceous material.

10. A delivery device as claimed in claim 1 in which said gas inlet conduit comprises a rigid steel tube, and a plurality of annular members surrounding said tube for holding the same in spaced relation with the elongate member.

11. A delivery device for injecting a gas into a mass of molten metal, the device comprising, in combination:

an elongate member of impermeable refractory material, the elongate member including a straight body portion and a straight head portion having an angled connection with the body portion, the head portion including a closed end, a side wall disposed between the closed end and the body portion, and a recess extending inwardly into the head portion from said side wall;

a porous refractory element located in the recess, the porous element being spaced from the interior of the head portion to define a centrally located chamber therein; and a gas inlet conduit positioned within the elongate member, the inner end of the conduit being in open communication with the chamber.

* * * * *